US008100279B2

(12) United States Patent
Nielsen et al.

(10) Patent No.: US 8,100,279 B2
(45) Date of Patent: Jan. 24, 2012

(54) STORAGE CONTAINER AND CORNER POST THEREOF

(75) Inventors: Ole Henrik Nielsen, Wanchai (HK); Daniel Wong, Taikoo Shing (HK)

(73) Assignee: Flex Box Limited, Wanchai (HK)

( * ) Notice: Subject to any disclaimer, the term of this patent is extended or adjusted under 35 U.S.C. 154(b) by 1364 days.

(21) Appl. No.: 11/699,230

(22) Filed: Jan. 26, 2007

(65) Prior Publication Data

US 2008/0179319 A1 Jul. 31, 2008

(51) Int. Cl.
*B65D 88/00* (2006.01)

(52) U.S. Cl. ..... 220/1.5; 410/4; 410/24; 410/26

(58) Field of Classification Search ..... 220/1.5; 410/4, 24, 26

See application file for complete search history.

(56) References Cited

U.S. PATENT DOCUMENTS

| | | | | |
|---|---|---|---|---|
| 3,061,134 | A * | 10/1962 | Fesmire et al. | 220/1.5 |
| 5,398,831 | A * | 3/1995 | Avramides et al. | 220/1.5 |
| 5,816,423 | A * | 10/1998 | Fenton et al. | 220/1.5 |
| 7,703,632 | B2 * | 4/2010 | Kochanowski | 220/666 |

FOREIGN PATENT DOCUMENTS

| | | |
|---|---|---|
| CN | 2832729 | 11/2006 |

OTHER PUBLICATIONS

Office action for corresponding Chinese Patent Application No. 200710146640.3, entitled "Storage Container and Corner Post Thereof", mailed Jun. 12, 2010 (5 pgs.).

English translation of Chinese Office action mailed Jun. 12, 2010 for corresponding Chinese Patent Application No. 200710146640.3, entitled "Storage Container and Corner Post Thereof" (7 pgs.).

* cited by examiner

*Primary Examiner* — Anthony Stashick
*Assistant Examiner* — Elizabeth Volz
(74) *Attorney, Agent, or Firm* — Christie, Parker & Hale, LLP

(57) ABSTRACT

A storage container is provided, having a first container and a second container. Each of the first and second containers includes top and bottom front rails, first and second front corner posts, and first and second side panels. In each of the first and second containers, the top and the bottom front rails and the first and second front corner posts are disposed at a front end thereof to define an opening into the interior thereof. The front end of the first container and the front end of the second container face each other. The first and second side panels of the first container are spaced to define a first interior width therebetween. The first and second front corner posts of the first container are spaced to define a second interior width therebetween. The first and second interior widths of the first container are substantially equal to each other.

16 Claims, 13 Drawing Sheets

STORAGE CONTAINER AND CORNER POST THEREOF

BACKGROUND OF THE INVENTION

The present invention relates to the field of storage containers, methods of formation of storage containers, and use of storage containers to ship goods.

Storage containers are used to transport goods across oceans on large ships, and across land on truck beds. In order to ship containers across seas, the containers must conform to the Convention of Safe Containers, which determines the dimensions and load capacities of different containers. Containers of predetermined dimensions are generally loaded into the cell (or on the deck) of a ship and stacked one upon another for transport. For example, it is known to provide containers measuring 20 feet in total length and 40 feet in total length for loading into the cell (or onto the deck) of a ship.

Storage containers are also used to store items at construction sites, homes, and elsewhere, and can be used accordingly upon completion of shipping on ships. Different sizes of storage containers may be desired according to the various applications for which the storage container may be used. For example, containers measuring 10, 16, or 24 feet in length may be desired according to various applications.

It is known to join two containers measuring 10 feet each in length to form the container measuring 20 feet in total length. The container measuring 20 feet in total length may be used during shipping and then separated into two containers measuring 10 feet in length. In this manner, the shipping of cargo using containers can proceed according to the length requirement, and the later use of storage containers can proceed according to the length desired for the particular application.

For a standard 40 foot container, it is known to provide a tunnel extending along a bottom surface of the container. The tunnel allows the 40 foot container to rest on the bed of a chassis with or without a gooseneck, where it can be used to ship cargo over land.

SUMMARY

In one embodiment of the present invention, a storage container includes a first container. The first container includes a top front rail, a bottom front rail, a first front corner post, a second front corner post, a first side panel, and a second side panel. The top front rail, the bottom front rail, the first front corner post and the second front corner post of the first container are disposed at a front end of the first container to define an opening into the interior of the first container. The first and second side panels of the first container are spaced to define a first interior width therebetween. The first and second front corner posts of the first container are spaced to define a second interior width therebetween. The first and second interior widths of the first container are substantially equal to each other.

In another embodiment, the first container is combined with a second container. The second container includes a top front rail, a bottom front rail, a first front corner post, a second front corner post, a first side panel, and a second side panel. The top front rail, the bottom front rail, the first front corner post and the second front corner post of the second container are disposed at a front end of the second container to define an opening into the interior of the second container. The front end of the first container and the front end of the second container face each other.

In another embodiment, the first and second side panels of the second container may be spaced to define a first interior width therebetween. The first and second front corner posts of the second container may be spaced to define a second interior width therebetween. The first and second interior widths of the second container may be substantially equal to each other.

In other embodiments:

The first and second interior widths of the first container and the first and second interior widths of the second container may be substantially equal to one another;

At least one front corner post of the first and second front corner posts of the first container may include a base, a first leg and a second leg to form a U-shaped portion and may further include an end connecting portion extending from the first leg and parallel to the base;

A surface of the end connecting portion may contact an end portion of the corresponding side panel;

The at least one front corner post may further include a return end portion extending from the second leg and parallel to the base;

The return end portion may have a first end and a second end. The first end may be attached to the second leg, and the return end portion may be longer than any remaining portion of the at least one front corner post that extends from the second end;

The first container may further include a first front panel disposed between the first and second front corner posts of the first container;

The second container may further include a second front panel disposed between the first and second front corner posts of the second container; and/or The storage container may further include a joining apparatus disposed between the front end of the first container and the front end of the second container. The joining apparatus may engage the first and second front corner posts of the first container and the first and second front corner posts of the second container to define an inner volume of the storage container.

DETAILED DESCRIPTION

Figure 1:
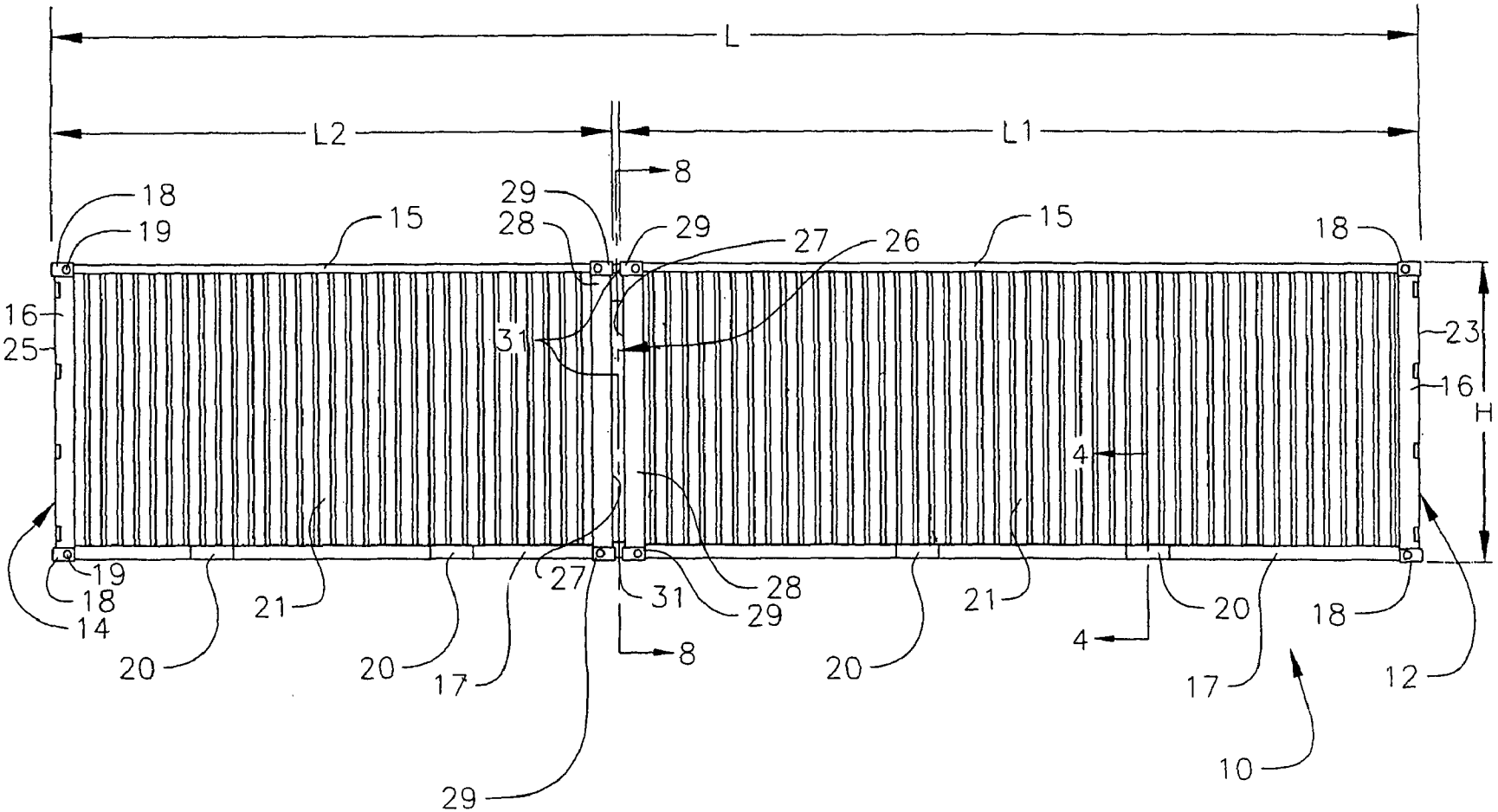
FIG. 1 is a side view of a completed storage container according to an exemplary embodiment of the present invention.

With reference to FIG. 1, a completed storage container 10 for the storage and transport of goods includes a first container 12 and a second container 14. The first container 12 and the second container 14 are attached to one another, as described below, to form the completed container 10. The completed container is 40 feet in length according to a dimension L, which is a length used to form shipping containers.

The completed container 10 is generally used to ship cargo in a ship across seas. Upon arrival at a shipping destination, the completed container 10 is capable of being separated into the first and second containers 12, 14, as described below. Upon separation from one another, the first and second containers 12, 14 may be used for separate applications. The completed container is generally made of steel of different varieties, but may be made of any suitable material. Anti-corrosive steel or an equivalent is often used to form the completed container 10.

The completed container 10 includes four corner posts 16 (two not seen) extending vertically according to the dimension H along junctions of various panels used to form the completed container 10. The corner posts 16 are formed from rolled high tensile steel, for example. Top side rails 15 and bottom side rails 17 extend horizontally according to the dimension L along junctions of the panels. Corner fittings 18 are located at the top and bottom of the corner posts 16. The corner fittings 18 are formed of casted weldable steel, for example. The corner posts 16 are designed to bear the load of the containers, particularly as the containers are stacked one on top of another in the ship silo or on a loading dock, as is known in the art. The corner posts 16 also provide structural support for lifters which grasp the completed container at the corner fittings 18 and corner posts 16 to stack and/or transport individual completed containers at a loading dock or on a ship, as known in the art. The corner fittings include openings 19 for engagement by the lifters. The corner posts 16 and the rails 15, 17 are welded into the corner fittings 18.

The completed container 10 is formed with panels and doors. Side panels 21 extend between the corner posts 16 along the length L of the completed container 10. The side panels 21 are corrugated in order to provide structural rigidity to the completed container 10. A top panel (not shown) extends along a top surface of the completed container 10 between the top rails 15. A first end 23 and a second end 25 of the completed container 10 each include doors, described in more detail below. The completed container also includes a bottom (not shown) extending between the bottom rails 17. The side panels 21, top panel, bottom and doors located at the first and second ends 23, 25 together define an inside area of the completed container.

The first container 12 is 24 feet in length according to a dimension L1, and can be separated from the second container 14, as described below. The length L1 of the separated first container 12 is beneficial for use on the bed of transport trucks, as well as for storage applications involving pipe, which often measures approximately 24 feet. The second container 14 is approximately 16 feet in length according to a dimension L2. The length L2 of the separated second container 14 is particularly beneficial for use in storage applications where a 10 foot container is too small and a 20 foot container is too long. The first or second container 12 or 14 may also be placed on flat rail cars and secured by twistlocks at the bottom corner fittings of the first or second container. The first and second containers may be used in a variety of applications, and may remain permanently attached to one another, according to the application for which the completed container 10 is to be used. It will also be appreciated that other length containers may be used to form a 40 foot container, such as a 25 foot first container and a 15 foot second container.

The first and second containers 12, 14 are joined at a junction point 26 of the completed container 10. At the junction point 26, the first and second containers each include a front end 27. The front ends 27 of the first and second containers 12, 14 include corner posts 28, similar to the corner posts 16 in form and function, and corner fittings 29, similar to the corner fittings 18. The front ends 27 are joined together by a joining apparatus 31, as described below, to form the completed container 10. When detached from each other, the front ends 27 of the first and second containers 12, 14 may be provided with front panels (not shown) attached thereto, as described below. With the front panels attached to the front ends 27, the first and second containers 12, 14 are used for their respective applications, as described above.

The first and second containers 12, 14 are lifted using forklift pockets 20 located along a lower edge of the containers, near a surface on which the containers rest. The forklift pockets, explained in greater detail below, extend laterally along a bottom of the containers 12, 14, and are spaced along the lengths L1 and L2 to allow for engagement with a fork lift, which lifts the first or second container as known in the art.

Figure 2:
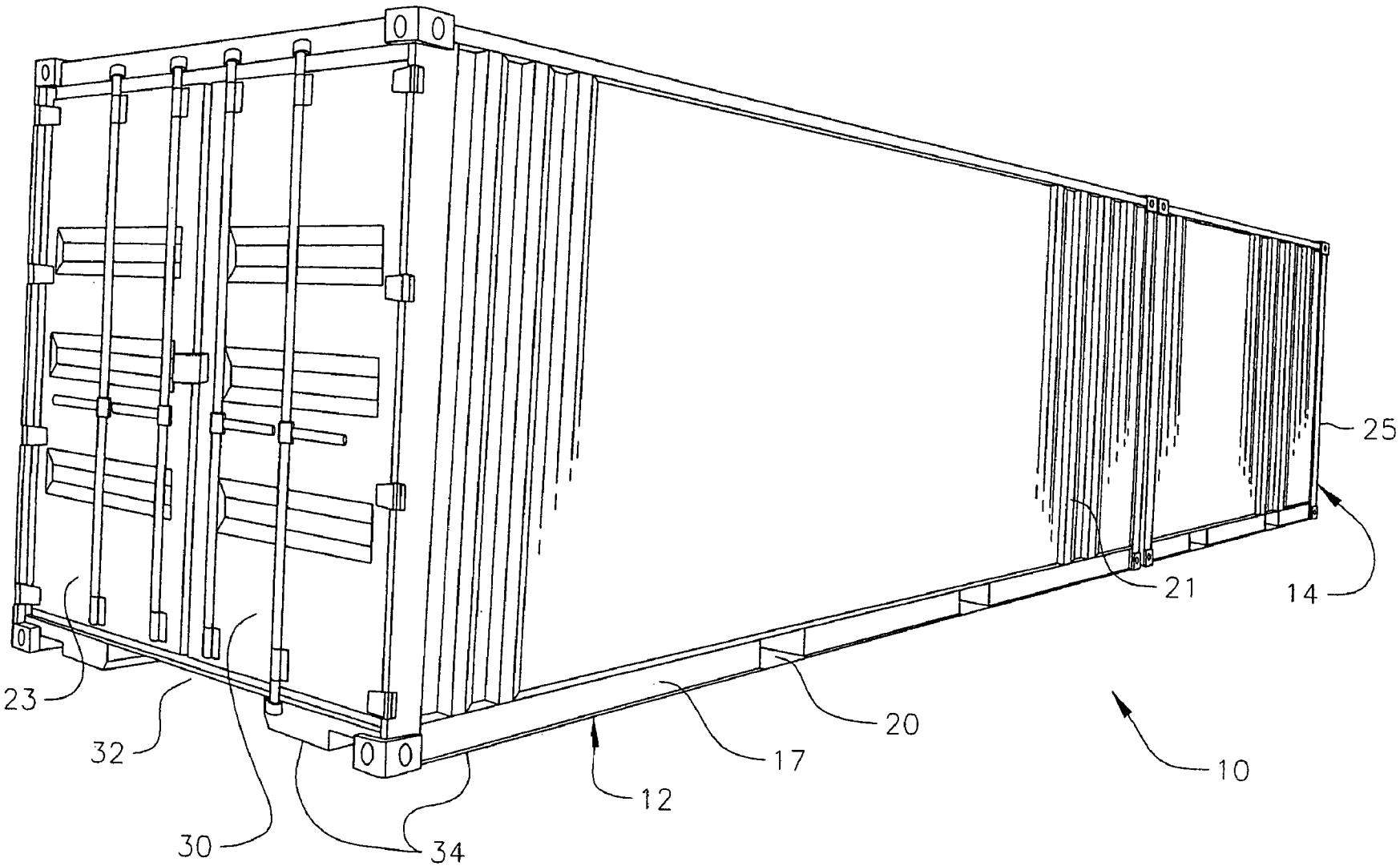
FIG. 2 is a side perspective view of the container of FIG. 1.

With reference to FIG. 2, the first container 12 includes a door 30 at the first end 23 of the completed container 10. The second container 14 may also be provided with a door (not shown) at the second end 25 of the completed container. When used, the second door is typically tack welded shut for customs purposes. The door 30 of the first container 12 provides access to an inside area of the container, and through it, items may be placed in the completed container 10. At the first end, a tunnel 32 extends along a bottom surface 34 of the first container 12, toward the second container 14.

Figure 3:
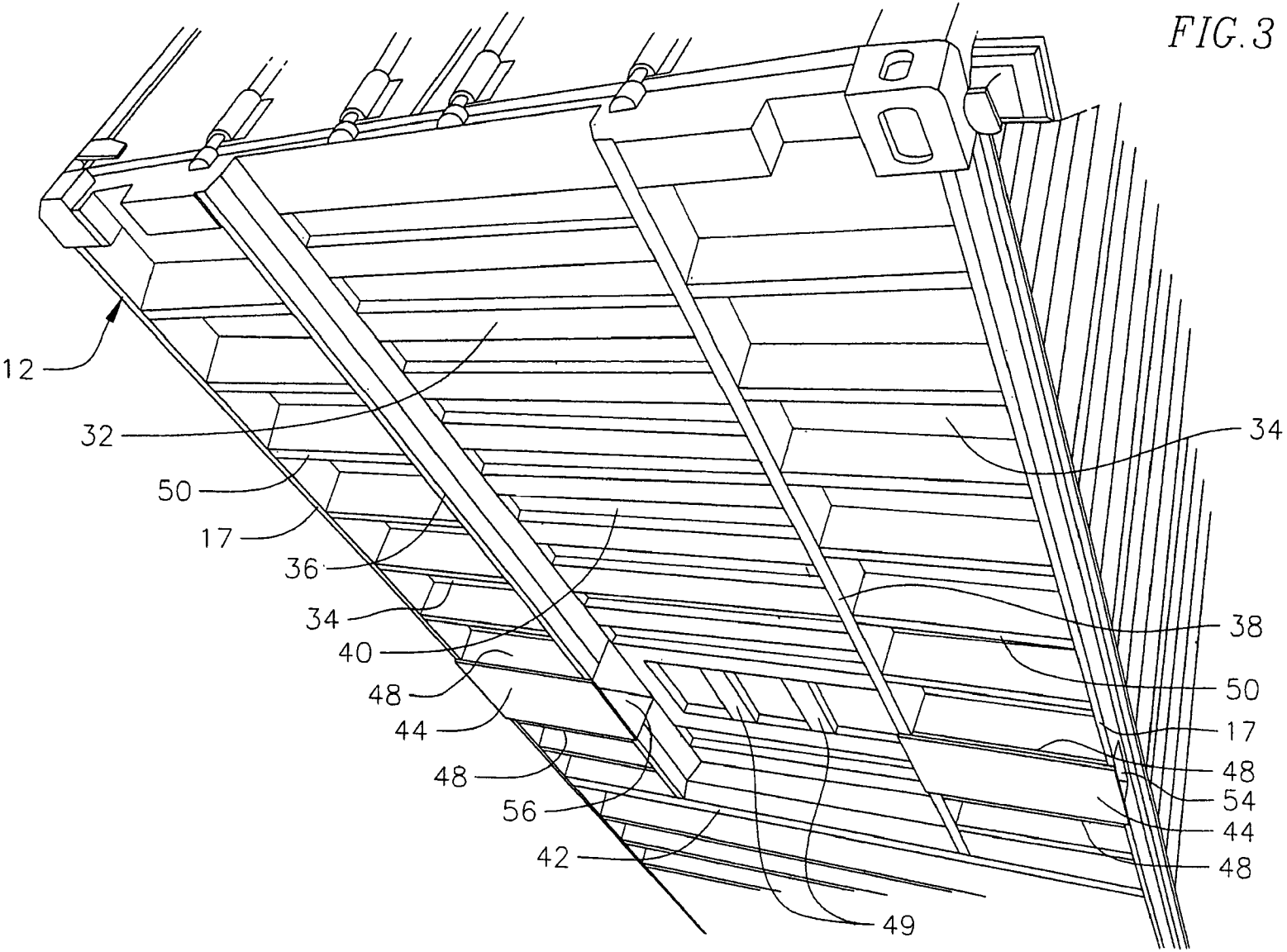
FIG. 3 is a bottom perspective view of the container of FIG. 1.

With reference to FIG. 3, the tunnel 32, sometimes called a gooseneck tunnel, extends along a portion of the first container 12. A common application of the container 10 involves use with transport trucks. The tunnel 32 of the container 10 is configured to interact with a bed (or gooseneck) of a transport truck. The tunnel 32 is defined by a first side rail 36 and a second side rail 38 running approximately parallel to one another, a tunnel plate 40 extending between the first side rail and second side rail, and a back rail 42 extending between the first and second rails 36, 38. One of the forklift pockets 20 of the first container 12 extends laterally across the first container adjacent to the bottom surface 34, and intersects with the tunnel 32.

Figure 4:
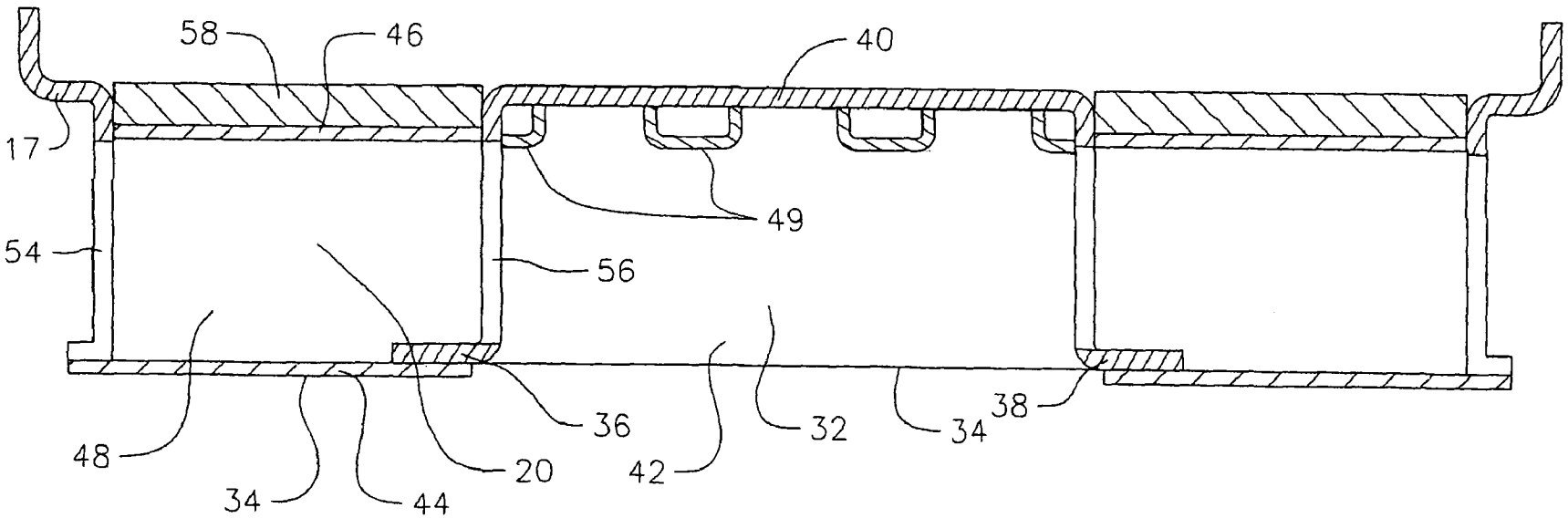
FIG. 4 is a cross-sectional view according to the line 4-4 of FIG. 1.

With reference to FIGS. 3 and 4, the forklift pocket 20 is defined by a bottom plate 44, a top plate 46, and fork lift pocket cross members 48. Additional cross members 50 are placed laterally along the bottom surface 34 of the first container 12 at predetermined intervals to provide structural support to the container and to provide an offset between the surface on which the container rests and the inside area of the container, thus allowing container contents to remain dry should moisture collect around the bottom surface 34 of the container. The cross members 48, 50 are welded into the first and second side rail 36, 38 in the area of the tunnel 32. Toward outer edges of the bottom surface 34, the cross members are welded to the bottom side rails 17. In the area of the forklift pockets, openings 54 are placed in the bottom side rails 17 through which prongs of a forklift may pass into the forklift pocket. Openings 56 are also placed in the first and second rails 36, 38 of the tunnel 32, allowing passage of the forklift prongs into the tunnel 32. The openings 56 in the first and second rails 36, 38 allow the forklift to lift the container. For example, a container having openings in the side rails 36, 38 of the tunnel 32 allows a forklift to lift the container at the top plate 46 of the forklift pocket 20 and at bearing members 49 attached to the tunnel plate 40, whereas a container not having the openings 56 allows a fork lift to lift only along the top plate 46 of the forklift pocket as the side rails 36, 38 of the tunnel 32 create a barrier through which the forklift cannot pass.

A container flooring 58 extends between the bottom side rails 17. The container flooring is formed of hardwood plywood, for example. In the area of the tunnel 32, the container flooring is interrupted by the tunnel plate 40. The cross members 48, 50 are secured to a bottom surface of the container flooring 58 by fasteners or other known means. The top plate 46 extends between the cross members 48 and is secured to the bottom surface of the container flooring 58. The top plate 46 is positioned offset to the tunnel plate 40 and the bottom side rails 17 such that an upper surface of the container flooring 58 co-extends with an upper surface of the tunnel plate 40, providing an even surface for the storage of goods within an inside area of the container.

The bottom surface 34 of the first container 12 is partially defined by the container flooring 58 in areas outside the forklift pocket (see FIG. 3). Cross members 48, 50 also partially define the bottom surface 34 (see FIG. 3), as do the bottom side rails 17 (see FIG. 2), the tunnel plate 40 (see FIG. 4), and the bottom plate 44 of the forklift pocket 20 (see FIG. 4).

With reference to FIGS. 1 and 5A to 5C, the front end 27 of the container 12 or 14 includes a top front rail 78, two vertically extending corner posts 28, and a bottom front rail 82. The rails 78, 82 and the posts 28 are joined by the corner fittings 29, into which the top side rails 15 and bottom side rails 17 are also joined (see FIG. 1). An opening into an inner area of the container in the front end 27 is defined by a top lip 90 of the top front rail 78, two side lips 92 of the corner posts 80, and a bottom lip 94 of the bottom front rail 82. The lips 90, 92, and 94 are used to secure a front panel of the container 12 or 14, as described below.

The top front rail 78 includes an upwardly facing surface 96 on the top lip 90. The corner posts 80 include end surfaces 98 on the side lips 92. The bottom front rail 82 includes an outwardly facing surface 100. The surfaces 96, 98, and 100 are used to secure a joining panel, described below, to the container 12 or 14. The opening of one of the first and second containers 12, 14 is aligned with a similar opening in the other of the first and second containers 12, 14, and the front ends 27 of the respective containers are joined to form the completed container 10 (see FIG. 1), as described below.

Figure 6B:
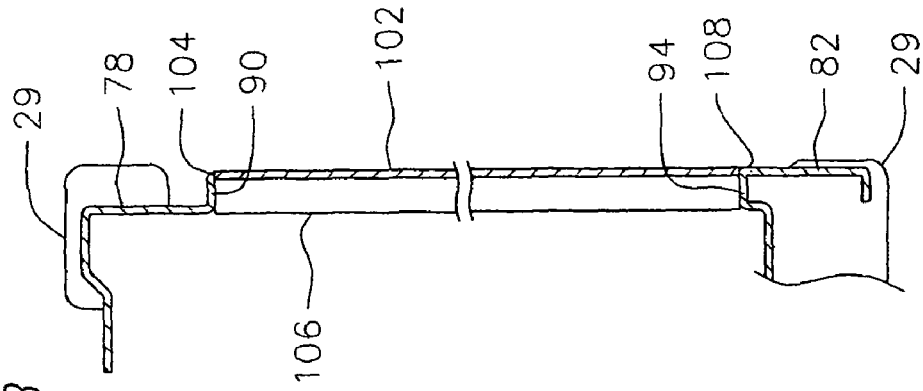
FIGS. 6A to 6C are a front view, a cross-sectional view according to the line 6B-6B of FIG. 6A, and a cross-sectional view according to the line 6C-6C of FIG. 6A, respectively, of the container of FIGS. 5A to 5C.
Figure 6A:
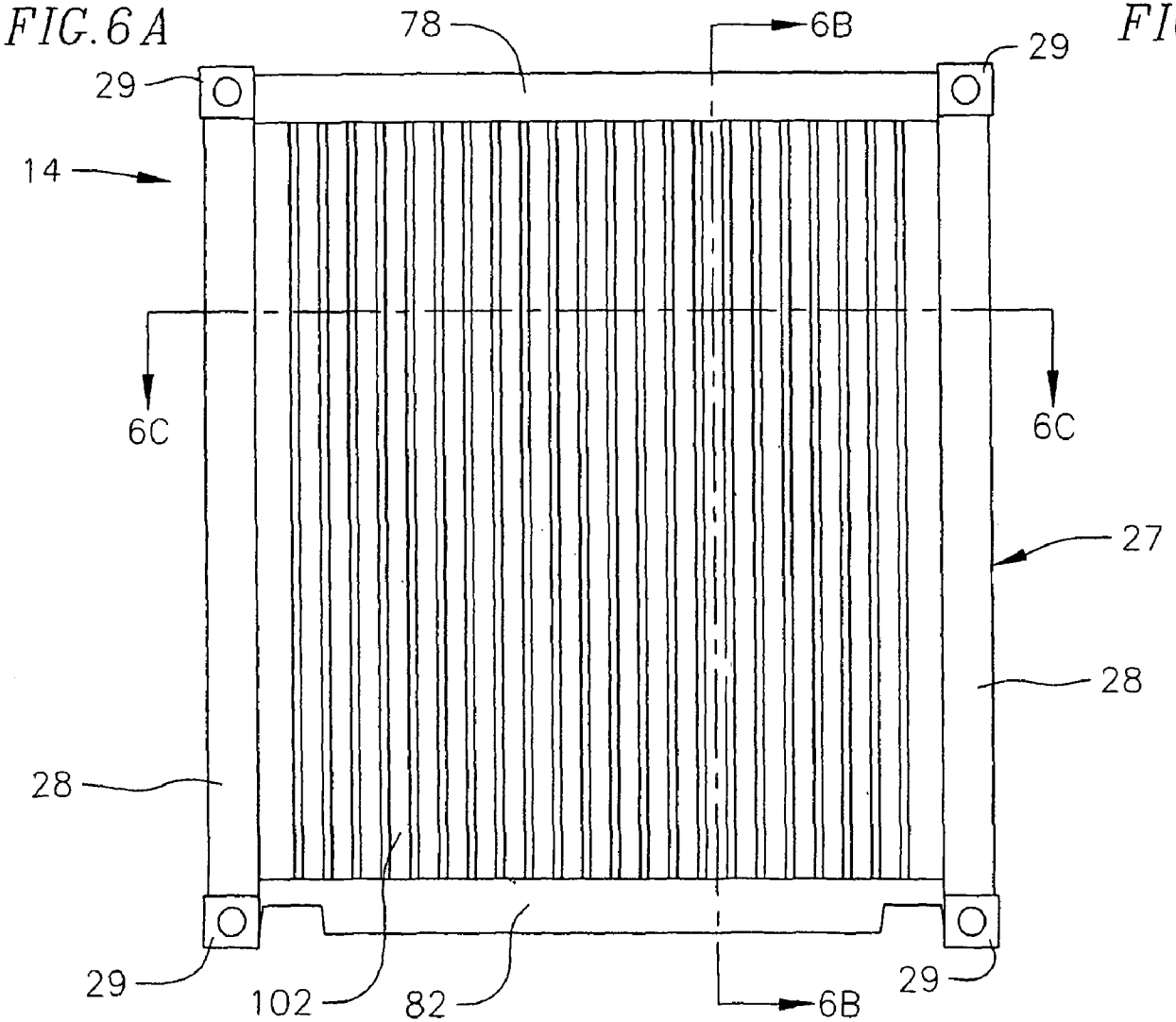
Figure 6C:
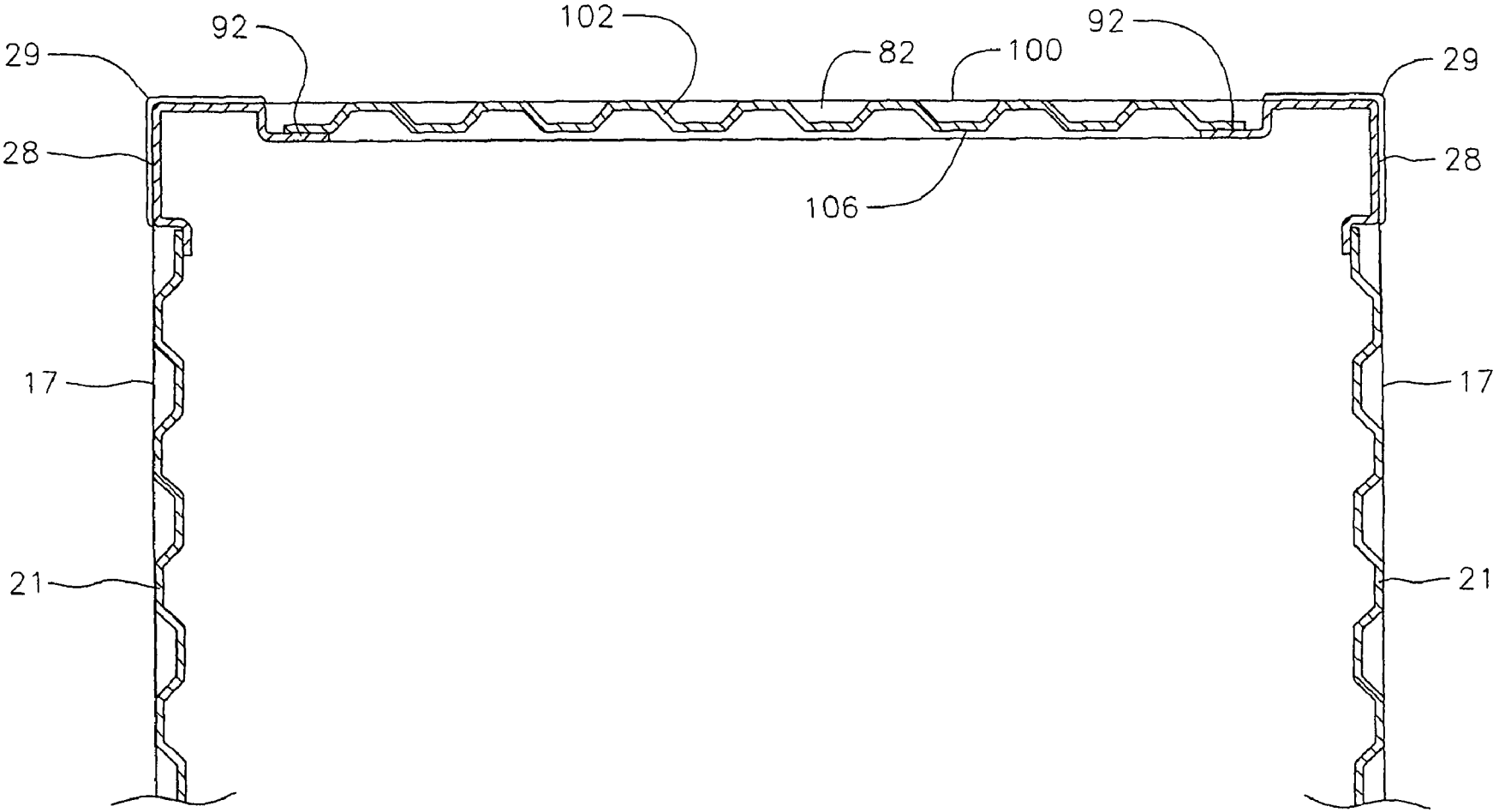

With reference to FIGS. 6A to 6C, the first or second container 12 or 14 are shown with a panel 102 attached to the front end 27 thereof. The front panels are not attached during loading or shipment, but are attached after the containers arrive at the destination and are removed from the ship. The front panel 102 is corrugated in shape, and matches the corrugation of the side panels 21 of the first and second containers 12, 14 (see FIG. 1). The front panel 102 includes a top end surface 104, an inner surface 106, and bottom end surface 108.

According to an exemplary method of the invention, the front panels 102 of the first and second containers 12, 14 may be mounted to the inside area of one or both of the containers 12, 14 for transport during shipping of the completed container 10 (see FIG. 1). The front panels 102 are secured to the side panels 21 in the inside area of the container 12 or 14. The corrugated profile of the front panels 102 matches that of the side panels 21 such that the front panels 102 nest into the side panels 21, maximizing the inside area in which cargo or other storage items can be placed when the front panels 102 are secured to the side panels 21. The front panels 102 may be tack welded onto the side panels 21. Alternatively, the front panels 102 may include openings for engagement with a hook or a lashing ring, the hook or lashing ring being mounted on the side panel 21.

Once the container arrives at its destination and is unloaded, the front panels can be attached to the front ends 27 of the first and second containers. The top end surface 104 is secured to the top lip 90 of the top front rail 78 as shown in FIG. 6B. The inner surface 106 of the panel 102 is secured to the second lips 92 as shown in FIG. 6C. The bottom end surface 108 is secured to the bottom lip 94 of the bottom front rail 82. The front panel 102 may be secured to the container 12 or 14 along the lips 90, 92, and 94 by welding, for example.

Figures 5A, 5B, 5C:
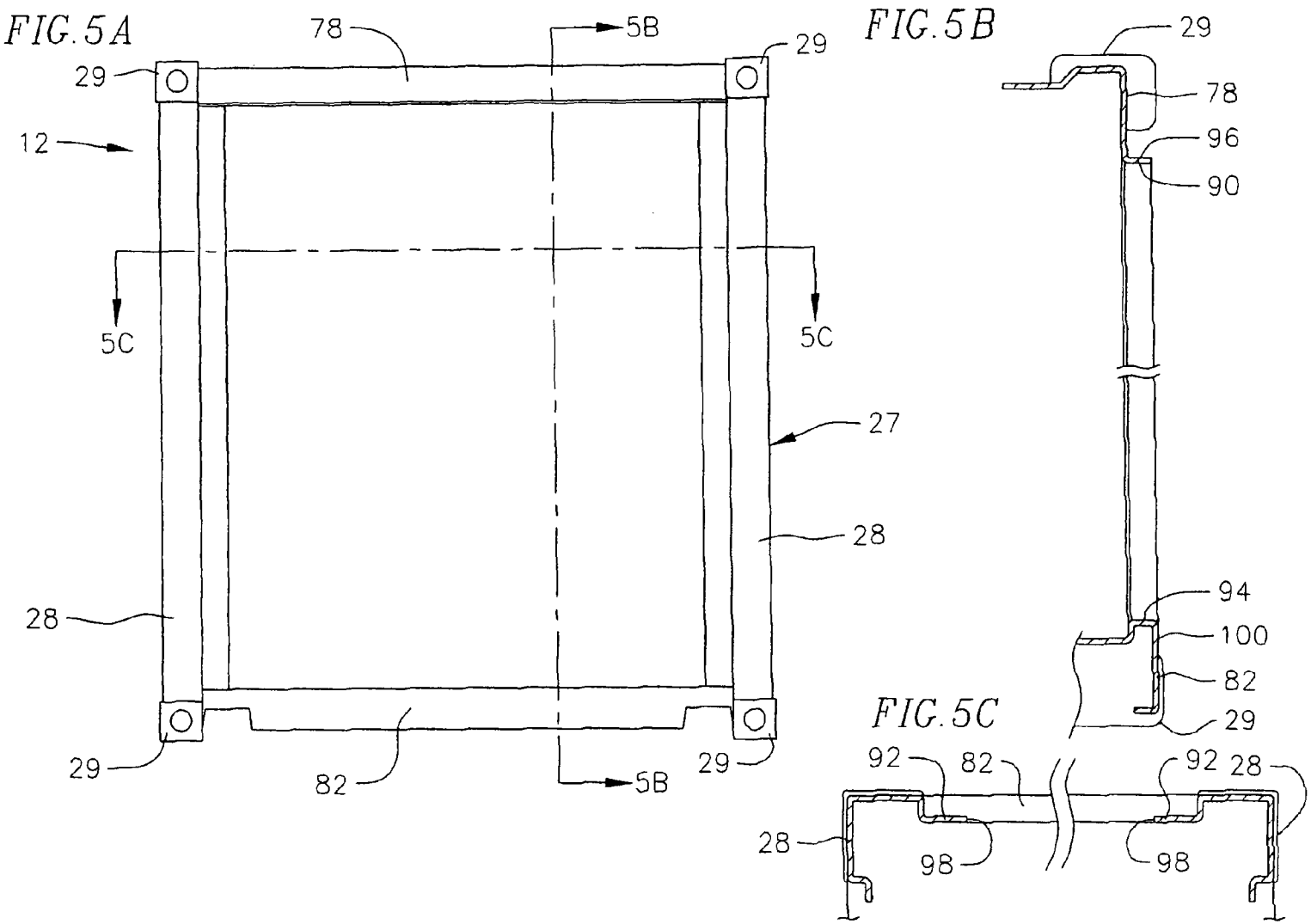
FIGS. 5A to 5C are a front view, a cross-sectional view according to the line 5B-5B of FIG. 5A, and a cross-sectional view according to the line 5C-5C of FIG. 5A, respectively, of a storage container according to an exemplary embodiment of the present invention.

The front ends 27 of the first and second containers 12 and 14 are placed adjacent to one another in order to form the completed container 10 (see FIG. 1). To form the completed container, the front panels 102 are not attached to the front ends 27, as shown in FIGS. 5A to 5C. Rather, the panels 102 may be mounted to the side panels 21 either before or after the formation of the completed container, as described above.

Figure 7B:
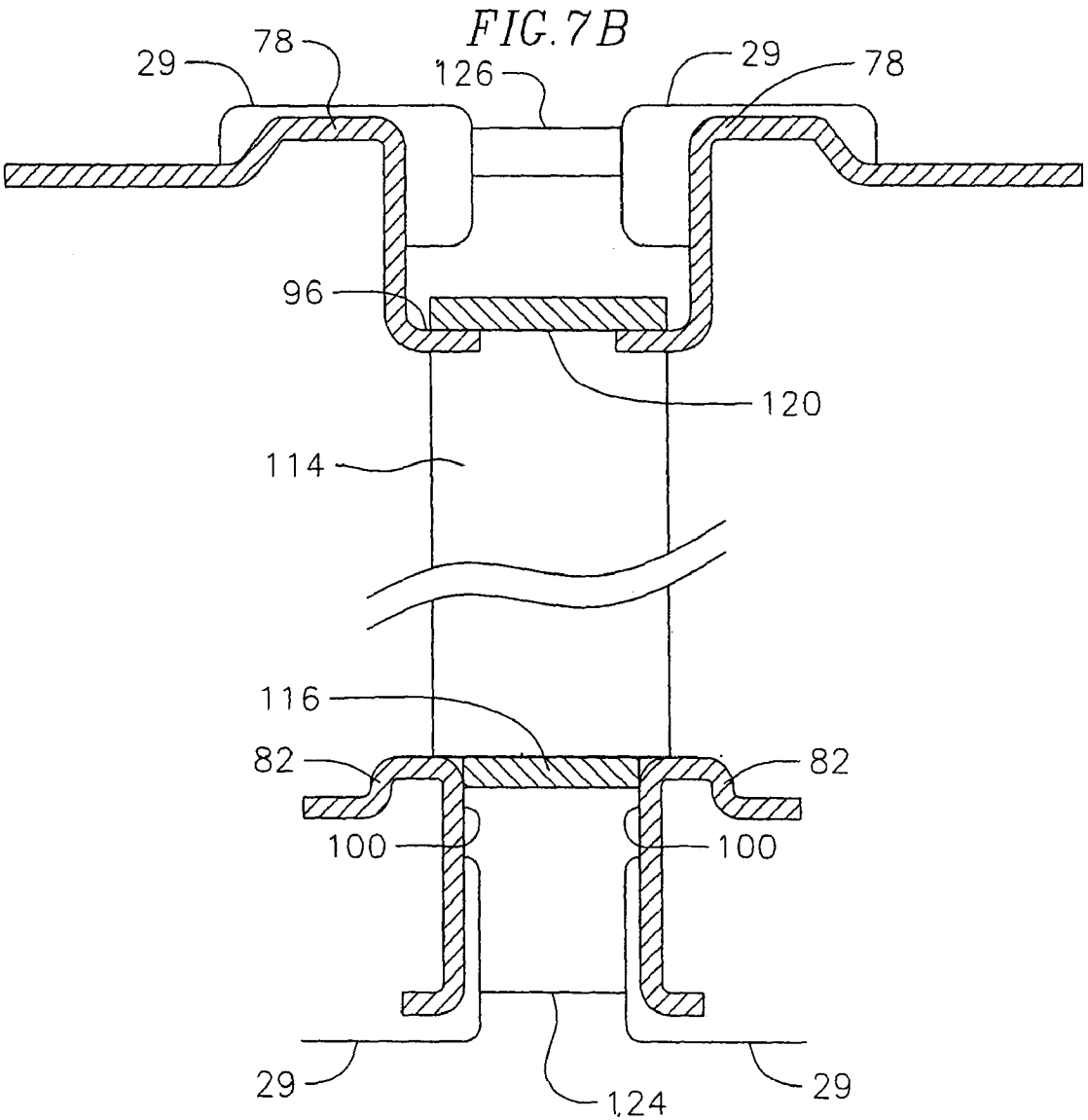
FIGS. 7A and 7B are cross-sectional views of a joining panel with and without containers attached thereto, respectively, according to an exemplary embodiment of the present invention.
Figure 7A:
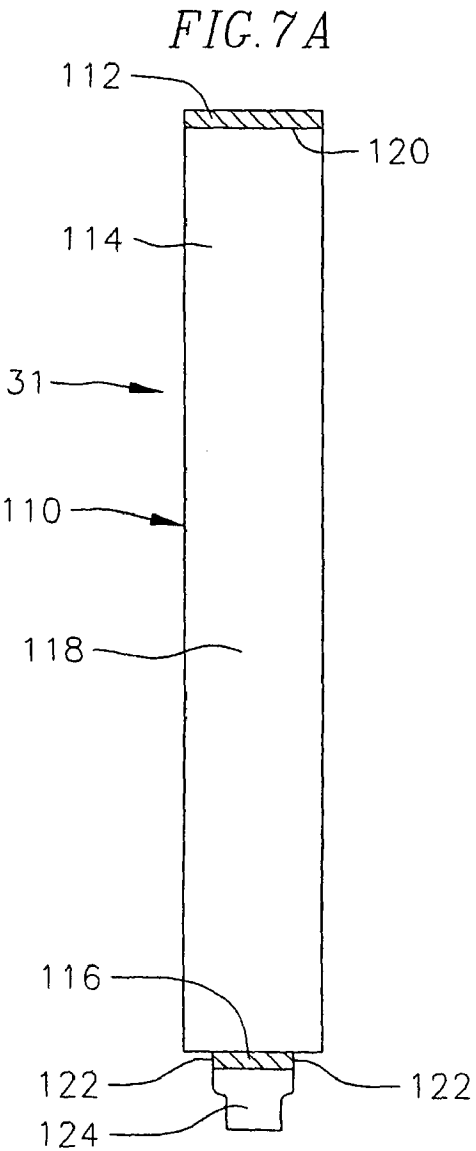
Figure 8:
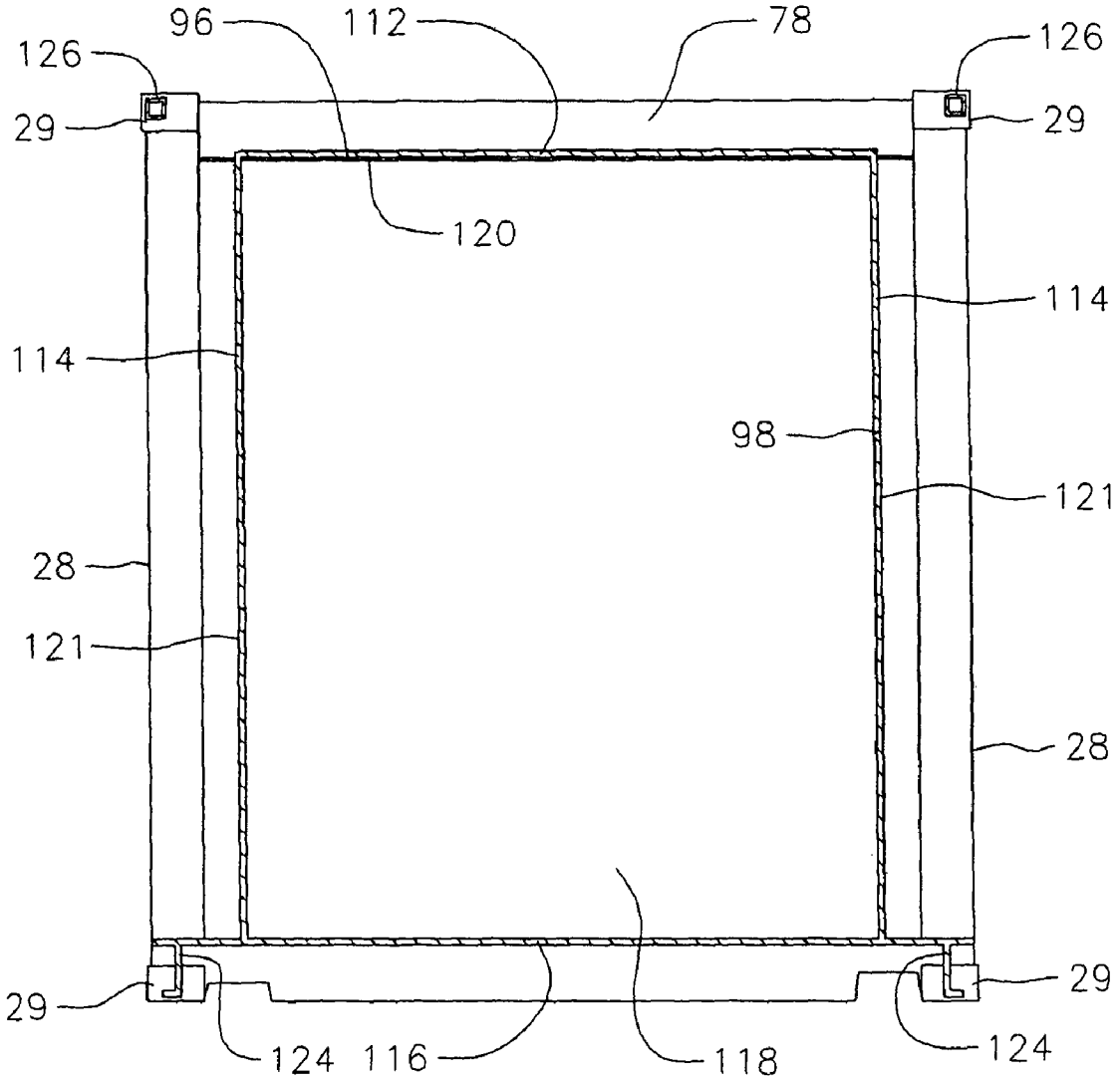
FIG. 8 is a cross-sectional view according to the line 8-8 of FIG. 1.

With reference to FIGS. 7A to 8, the joining apparatus 31 (see FIG. 1) for joining the first and second containers 12, 14 includes a joining panel 110 used to place inside areas of the first and second containers 12, 14 in communication with one another. The joining panel 110 includes a top joining panel 112, two side joining panels 114, and a bottom joining panel 116. The joining panel 110 includes an opening 118 extending therethrough. The top joining panel 112 includes a downwardly facing surface 120 which is secured to the upwardly facing surfaces 96 of the top front rails 78. The side joining panels 114 include an outwardly facing surface 121 which is secured to the end surfaces 98 of the corner posts 28 (see FIG. 5C). The bottom joining panel 116 includes end surfaces 122 which are secured to the outwardly facing surfaces 100 of the bottom front rails 82. Slots can be provided in the top front rails 78 to receive the side joining panels 114. The connections may be made by welding, for example. The joining panel 110 is thus placed between the first and second containers 12, 14, with the front panels 102 (see FIGS. 6A to 6C) removed therefrom, and secured to the first and second containers 12, 14. The opening 118 is placed in communication with the inside area of the containers, forming the completed container having a through opening extending the entire length L of the completed container 10 (see FIG. 1). The bottom joining panel 116 extends in a plane similar to that of the bottom lip 94 such that the bottom surface of the inside area of the completed container is even throughout.

The joining apparatus 31 further includes rails 124, 126, which are used to secure the first and second container 12, 14 at the corner fittings 29. Bottom joining rails 124 extend downwardly from the bottom joining panel 106 and are secured to opposing bottom corner fittings 29. Top joining rails 126 are secured to the opposing upper corner fittings 29. Alternatively, the bottom joining rails 124 may have substantially the same shape and/or form as the top joining rails 126. The rails 124, 126 may be welded to the first and second containers 12, 14. Once the first and second containers 12, 14 are joined, the completed container 10 can be filled with cargo and shipped as desired.

Upon arrival at a shipping destination, the completed container 10 may be cut in order for separate use of the first and second containers 12, 14, according to their respective applications. The completed container is cut along junctions between the joining panel 110 and the top front rail 78, corner posts 28, and bottom front rail 82. Additionally, the completed container is cut along junctions between the bottom joining rails 124 and the bottom corner fittings 84, and along the junctions between the top joining panels 126 and the top corner fittings 84. Separation of the first and second containers 12, 14 occurs by processes known in the art. The joining panel 110 and the joining rails 124, 126 can then be thrown away or used for scrap.

The front panels 102 can be removed from the side panels 19 and secured to the front ends 27 of the first and second containers 12, 14 upon separation of the first and second containers 12, 14, as shown in FIGS. 6A to 6C. For example the tack welds described earlier, used to attach the front panels 102 to the side panels 21, can be grounded down to release the front panels 102 from the side panels 21. Or, front panels 102 attached to side panels 21 with hooks or lashing rings may be removed therefrom. The front panels 102 may then be secured to the front ends 27 of the first and second containers 12, 14, as shown in FIGS. 6A to 6C. The two separate containers 12, 14 may then be used for their respective applications.

Figure 9:
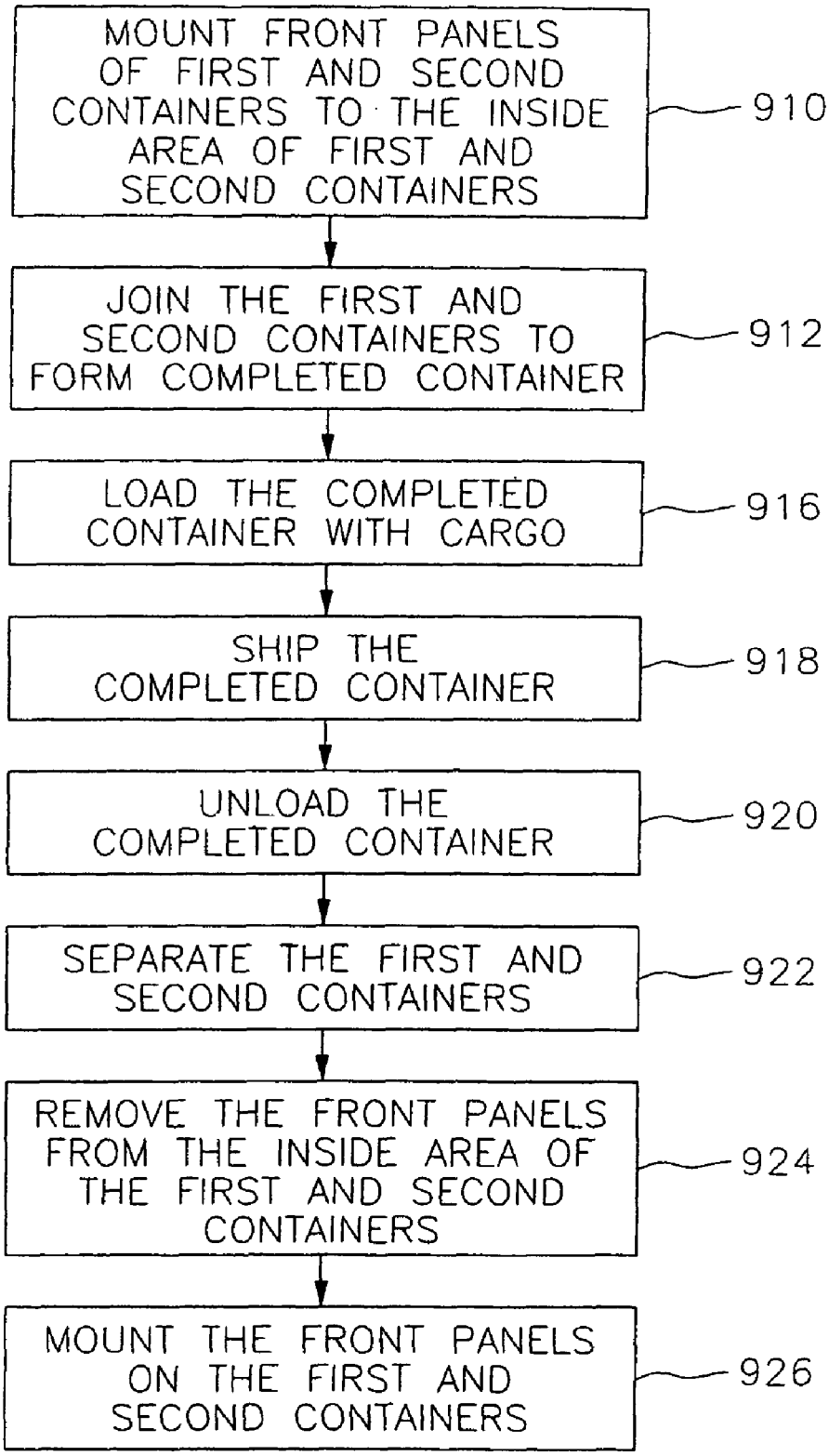
FIG. 9 is a flow chart of a process for use of a storage container according to aspects of the present invention.

With reference to FIG. 9, a flow chart of a process for use of the storage container is shown. In block 910, the front panels of the first and second containers are mounted to the inside area of the first and second containers, creating an opening into the inside area of the first and second containers at the front panels. In block 912, the first and second containers are joined together, forming the completed storage container. To accomplish this, the front panels are placed adjacent to one another with their respective openings in communication with one another, forming the completed storage container. In block 916, the completed container is loaded with cargo in the inside area of the completed container. In block 918, the completed storage container is shipped with the cargo loaded therein. In block 920, the cargo is unloaded from the container upon arrival at a destination. In block 922, the completed container is separated into the first and second containers. In block 924, the front panels are removed from the inside area. In block 926, the front panels are mounted onto the fronts of the first and second containers.

The present invention may be used according to an advantageous financing model. The completed container 10 may be formed at a shipping origin. The completed container 10 may be used to ship cargo across seas from the shipping origin to a shipping destination. The completed container 10 may be rented to a shipping company, which uses the container for the shipping of cargo from the shipping origin to the shipping destination. The storage container may be sold to a third party, preferably at the shipping destination, for use in shipping across sea or land, or sold as a container for the storage of goods, as described above. In this manner, the manufacturer or seller of storage containers can transfer containers from a shipping origin to a shipping destination without having to pay the shipping costs associated with shipping the containers as cargo. One way rental of the completed container also precludes the necessity of having to pay the costs associated with the return of the completed container 10, or any portion thereof, to the shipping origin.

Figure 10A:
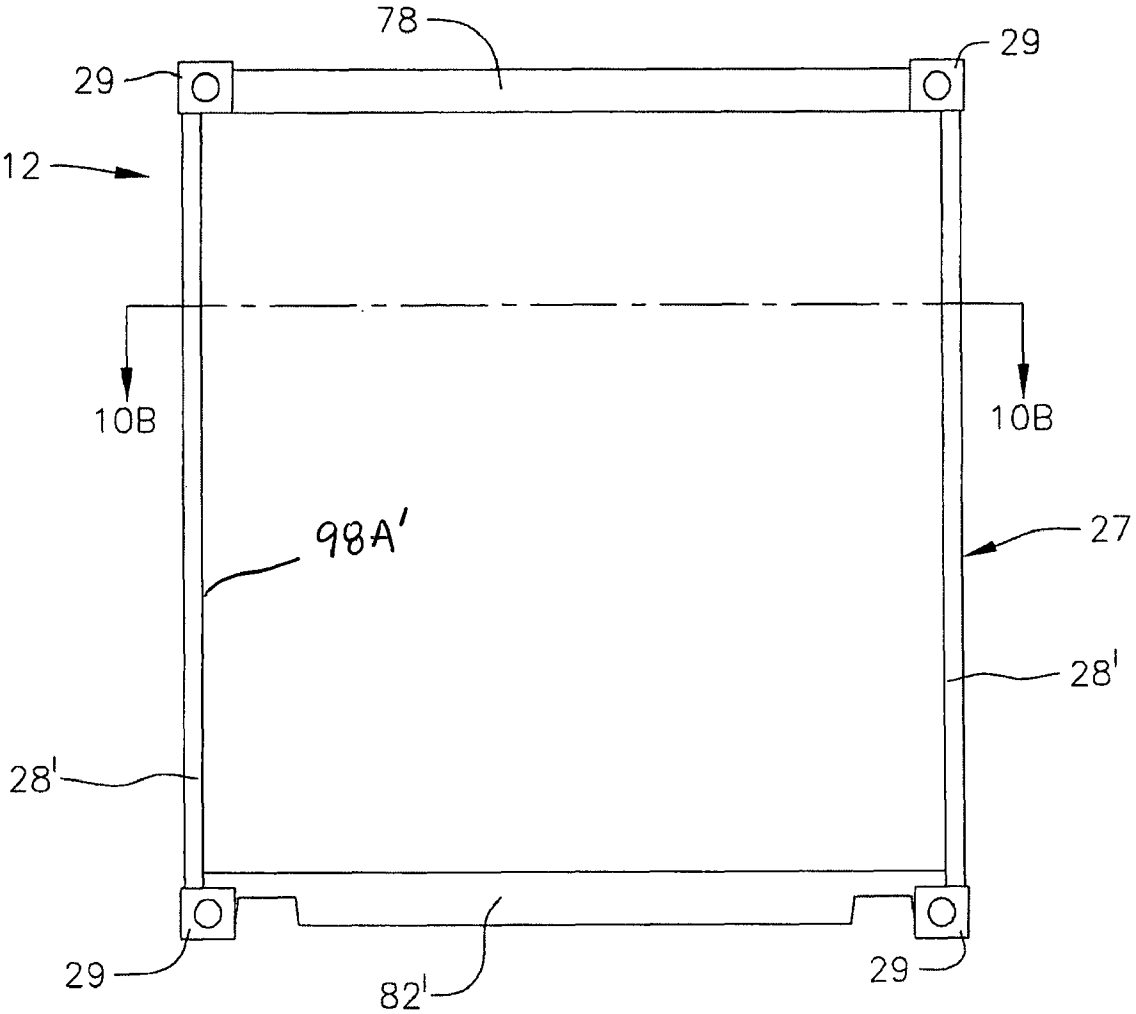
FIG. 10A is a front view of a storage container according to an embodiment of the present invention.

In another embodiment, with reference to FIG. 10A, the front end 27 of the first container 12 includes two vertically extending corner posts 28', similar to the corner posts 16 in function, and corner fittings 29, similar to the corner fittings 18. The front end 27 further includes top front rail 78 and a bottom front rail 82'.

Figure 10B:
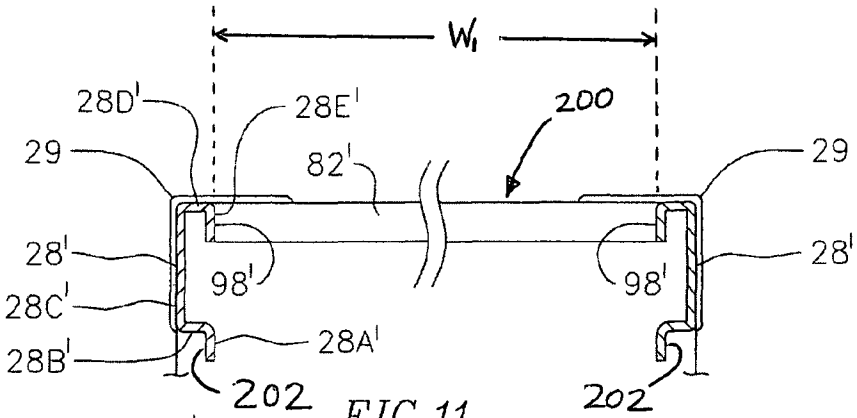
FIG. 10B is a cross-sectional view according to the line 10B-10B of the storage container of FIG. 10A.

With reference to FIG. 10B, in one embodiment, each corner post 28' includes a base 28C', first and second legs 28B' and 28D', a connecting end portion 28A', and a return end portion 28E'. The base 28C', the first and second legs 28B' and 28D', the connecting end portion 28A', and the return end portion 28E' have respective thicknesses that may be substantially equal to one another. The corner post 28' may be made of a metal or a metal compound, for example. The corner post 28' may be formed as a continuous structure, for example. Alternatively, the corner post 28' may be formed by joining the members 28A', 28B', 28C', 28D', and 28E' together, e.g., by welding.

The connecting end portion 28A' and the second leg 28D' are located at opposite ends of the corner post 28'. The connecting end portion 28A' abuts the first leg 28B' to form a substantially perpendicular angle. Similarly, the first leg 28B' abuts the base 28C' to form a substantially perpendicular angle. As such, the first leg 28B' couples the connecting end portion 28A' and the base 28C'.

The base 28C' abuts the second leg 28D' to form a substantially perpendicular angle. As such, the base 28C' couples the first leg 28B' and the second leg 28D'. Similarly, the second leg 28D' abuts the return end portion 28E' to form a substantially perpendicular angle. As such, the second leg 28D' couples the base 28C' and the return end portion 28E'. The return end portion 28E' has a surface 98' facing an inner area of the first container 12.

With reference to FIG. 10A, the base 28C' and the first and second legs 28B' and 28D' are disposed to define a shape similar to that of the letter 'U.' Similarly, the base 28C', the second leg 28D', and the return end portion 28E' are disposed to define a shape similar to that of the letter 'U.'

With reference to FIG. 10A, the bottom front rail 82' and the corner posts 28' are joined by the corner fittings 29. Similarly, the top front rail 78 and the corner posts 28' are joined by the corner fittings 29. An opening 200 (see FIG. 10B) into an inner area of the first container 12 at the front end 27 is defined by the surfaces 98' of the corner posts 28'. The corner posts 28' are spaced apart from each other such that the respective surfaces 98' define a first interior width $W_1$.

Figure 11:
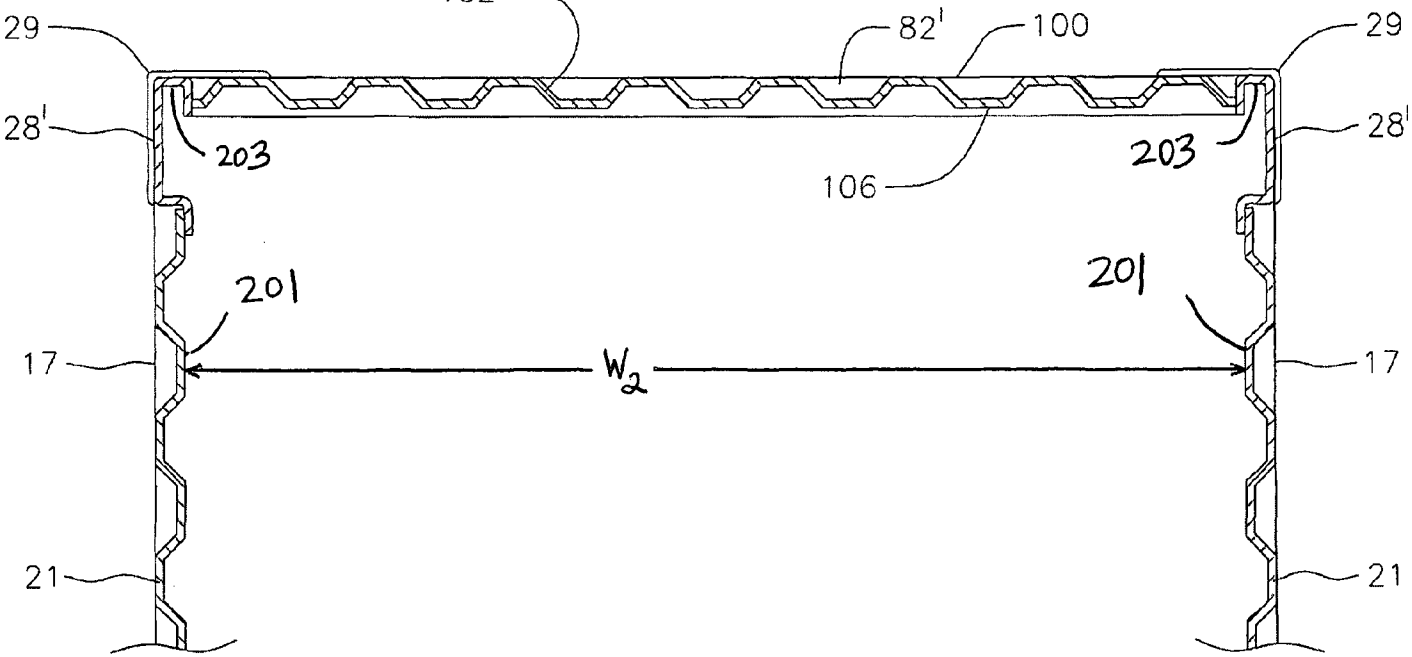
FIG. 11 is a cross-sectional view according to the line 10B-10B of a storage container according to another embodiment of the present invention.

With reference to FIG. 11, side panels 21 extend from the corner posts 28' along a length of the first container 12. The side panels 21 are similar to those described in previous embodiments and, as such, will not be described in more detail below. A portion of the side panel 21 is overlappingly engaged with a surface 202 of the connecting end portion 28A'. The surface 202 of the connecting end portion 28A' faces outward of the first container 12.

The side panels 21 are spaced apart from each other such that respective surfaces 201 of the side panels define a second interior width $W_2$. In an exemplary embodiment, the first interior width $W_1$ and the second interior width $W_2$ may be substantially equal to each other. For example, the first interior width $W_1$ may be shorter than the second interior width $W_2$ by the thickness of the connecting end portion 28A', due to the overlapping connection between the end portion 28A' and the side panel.

With reference to FIG. 11, the first container 12 may include a front panel 102' attached at the front end 27 thereof. The front panel 102' includes an inner surface 106. The front panel 102' is similar in form and function to that described in previous embodiments and, as such, will not be described in more detail below. An end of the front panel 102' is secured to the end surface 98' of one of the corner posts 28'. The other end of the front panel 102' is secured to the end surface 98' of the other of the corner posts 28'. The ends of the front panel 102' may be secured to the end surfaces 98' by welding, for example.

Similar to the front end 27 of the first container 12, the front end 27 of the second container 14 includes two vertically extending corner posts 28', similar to the corner posts of the first container 12, and corner fittings 29, similar to the corner fittings 29 of the first container 12. The front end 27 of the second container 14 further includes top front rail 78 and a bottom front rail 82', which are also similar to corresponding rails of the first container 12. A front panel 102' similar to that of the first container 12 may be disposed at the front end 27 of the second container 14. As such, the noted parts at the front end 27 of the second container 14 will not be described in more detail below.

The front ends 27 of the first and second containers 12 and 14 may be placed to face each other, e.g., in order to form a completed container having a through space from the interior of the first container, through the front ends of the first and second containers, into the interior of the second container.

According to an exemplary embodiment of the invention, the front panels 102' of the first and second containers 12, 14 may be mounted to the inside area of one or both of the containers 12, 14 for transport during shipping of the completed container. When not in use, the front panels 102' are secured to the side panels 21 in the inside area of the container 12 or 14. The corrugated profile of the front panels 102' matches that of the side panels 21 such that the front panels 102' nest into the side panels 21, maximizing the inside area in which cargo or other storage items can be placed when the front panels 102' are secured to the side panels 21. The front panels 102' may be tack welded onto the side panels 21. Alternatively, the front panels 102' may include openings for engagement with a hook or a lashing ring, the hook or lashing ring being mounted on the side panel 21.

Once the container arrives at its destination and is unloaded, the front panels can be attached to the front ends 27 of the first and second containers 12, 14.

Figure 12:
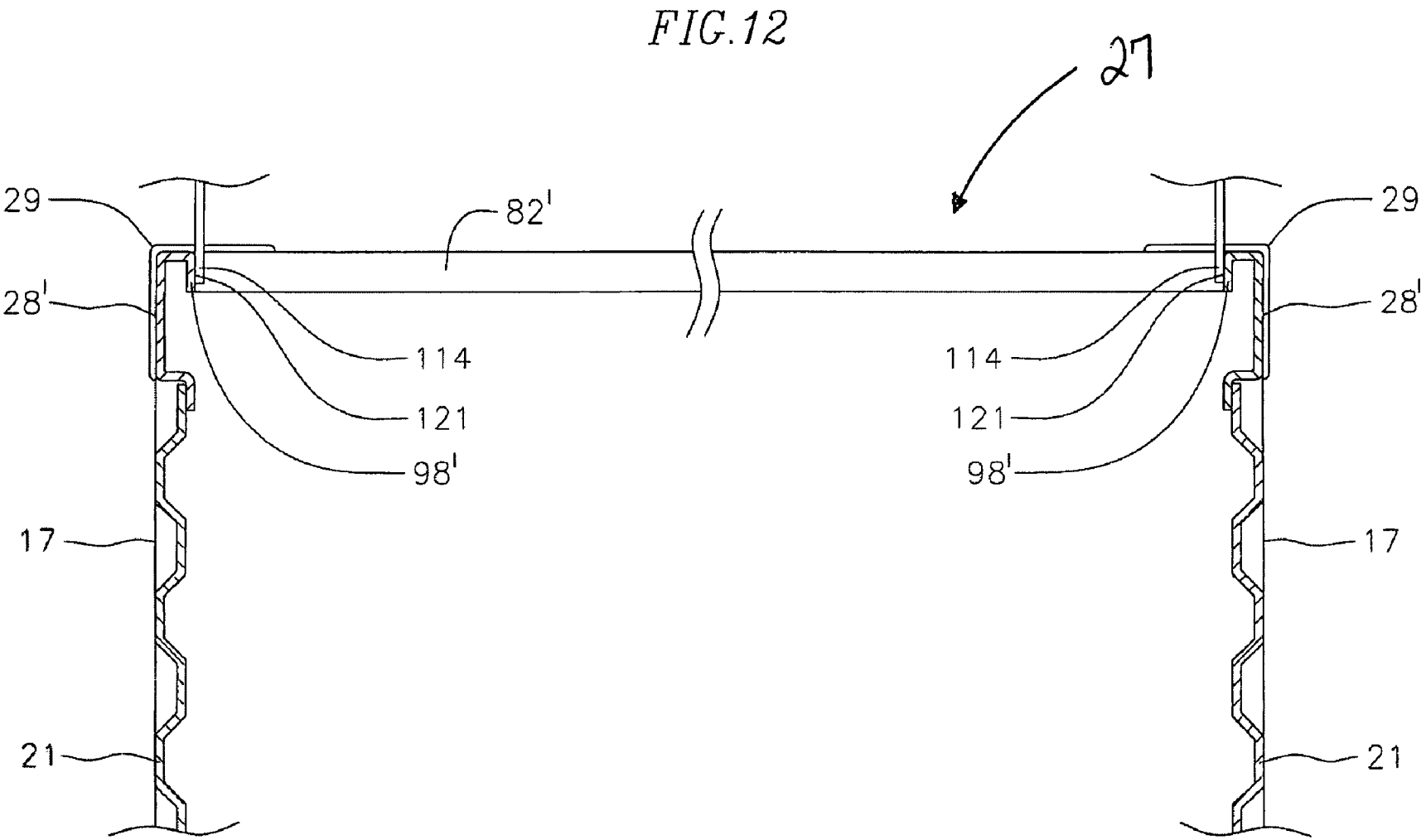
FIG. 12 is a cross-sectional view according to the line 10B-10B of a storage container according to yet another embodiment of the present invention.

In one embodiment, when the front panels 102' are not attached to the front ends 27 of the first and second container 12, 14, the joining apparatus 31 (see FIGS. 7A and 7B) can be used to join the first and second containers 12, 14 such that inside areas of the first and second containers 12, 14 are placed in communication with one another. The joining apparatus 31 is similar to that described in previous embodiments and, as such, will not be described in more detail below. As previously described with respect to previous embodiments, the joining apparatus 31 includes side joining panels 114. It will be appreciated by those skilled in the art that, in the current embodiment, the side joining panels 114 may be sized to have a width substantially equal to the first interior width $W_1$ (see FIG. 10B). With reference to FIG. 12, each side joining panel 114 includes a surface 121. The surface 121 is secured to the end surfaces 98' of the corner posts 28'. The securing can be performed by welding, for example.

When the above-described corner posts 28' are disposed at the front end of each container 12, 14, an internal capacity (or inner volume) of the container 12, 14 may be increased due to the first interior width $W_1$ (see FIG. 10B) being defined to be substantially equal to the second interior width $W_2$ (see FIG. 10B).

According to embodiments previously described, the corner post 28' includes the return end portion 28E' which provides additional structural support to the container 12, 14 at the front end 27 thereof. It will be appreciated by those skilled in the art that, alternatively, the corner post may not include the return end portion 28E'. That is, the corner post may include only the base 28C', the first and second legs 28B' and 28D', and the connecting end portion 28A'. Here, an end of the front panel 102' can be secured to (or can be disposed to overlap) surface 203 (see FIG. 11) of the second leg 28D', for example. Alternatively, the end of the front panel 102' may abut the corner post at one of the above-described portions of the corner post 28' or another portion of the corner post 28'. Furthermore, the surfaces 121 of the side joining panel 114 of the joining apparatus 31 can be secured to respective surfaces of the second legs 28D' that are spaced apart from each other by the first interior width $W_1$.

It will also be appreciated by those skilled in the art that, alternatively, the corner post 28' may include a remaining portion coupled with the return end portion 28E', opposite the second leg 28D', and extending further towards the opposite side panel 21. The remaining portion has an end surface facing an inner area of the container 12, 14. Here, such a remaining portion may be shorter than the return end portion 28E' such that an interior width of an opening (similar to opening 200 of FIG. 10B) defined by the end surfaces of remaining portions of corner posts disposed opposite each other may still be substantially equal to the second interior width $W_2$ (see FIG. 11).

Although this invention has been described in certain specific embodiments, many additional modifications and variations would be apparent to those skilled in the art. For example, the forklift pockets 20 and the tunnel 32 can have other configurations and structure. The bearing members 49 can be a single plate or several members of various shape for receiving the load of a fork of a forklift.

It is therefore to be understood that this invention may be practiced otherwise than as specifically described. Thus, the present embodiments of the invention should be considered in all respects as illustrative and not restrictive, the scope of the invention to be determined by any claims supportable by this application and the claims' equivalents.

What is claimed is:

1. A storage container comprising:

a first container including a top front rail, a bottom front rail, a first front corner post, a second front corner post, a first side panel, and a second side panel, the top front rail, the bottom front rail, the first front corner post and the second front corner post of the first container being disposed at a front end of the first container to define an opening into the interior of the first container;

a second container including a top front rail, a bottom front rail, a first front corner post, a second front corner post, a first side panel, and a second side panel, the top front rail, the bottom front rail, the first front corner post and the second front corner post of the second container being disposed at a front end of the second container to define an opening into the interior of the second container; and a joining apparatus removably coupled between the front end of the first container and the front end of the second container, the joining apparatus engaging the first and second front corner posts of the first container and the first and second front corner posts of the second container to place the interiors of the first and second containers in communication with one another and define an inner volume of the storage container, wherein the front end of the first container and the front end of the second container face each other;

wherein the first and second side panels of the first container are spaced to define a first interior width therebetween;

wherein the first and second front corner posts of the first container are spaced to define a second interior width therebetween;

wherein the first and second interior widths of the first container are substantially equal to each other; and wherein the joining apparatus comprises a first side joining panel removably coupled between the first front corner posts and a second side joining panel removably coupled between the second front corner posts, and the first and second side joining panels are spaced apart by a distance substantially equal to the second interior width.

2. The storage container of claim 1, wherein the first front corner post is formed of a material having a first corner post material thickness, the second front corner post is formed of a material having a second corner post material thickness, and the second interior width is at least as great as a difference between the first interior width and a sum of the first and second corner post material thicknesses.

3. The storage container of claim 1, wherein the first interior width is a distance between innermost surfaces of the first and second side panels in a widthwise direction extending between the first and second side panels, and the second interior width is a distance between innermost surfaces of the first and second front corner posts in the widthwise direction.

4. The storage container of claim 1, wherein the first and second side panels of the second container are spaced to define a first interior width therebetween;

wherein the first and second front corner posts of the second container are spaced to define a second interior width therebetween; and wherein the first and second interior widths of the second container are substantially equal to each other.

5. The storage container of claim 4, wherein the first and second interior widths of the first container and the first and second interior widths of the second container are substantially equal to one another.

6. The storage container of claim 1, wherein the first container further includes a first front panel coupleable between the first and second front corner posts of the first container.

7. The storage container of claim 6, wherein the second container further includes a second front panel coupleable between the first and second front corner posts of the second container.

8. A storage container comprising:

a first container including a top front rail, a bottom front rail, a first front corner post, a second front corner post, a first side panel, and a second side panel, the top front rail, the bottom front rail the first front corner post and the second front corner post of the first container being disposed at a front end of the first container to define an opening into the interior of the first container;

a second container including a top front rail, a bottom front rail, a first front corner post, a second front corner post, a first side panel, and a second side panel, the top front rail, the bottom front rail, the first front corner post and the second front corner post of the second container being disposed at a front end of the second container to define an opening into the interior of the second container; and a joining apparatus removably coupled the front end of the first container and the front end of the second container, the joining apparatus engaging the first and second front corner posts of the first container and the first and second front corner posts of the second container to place the interiors of the first and second containers in communication with one another and define an inner volume of the storage container, wherein the front end of the first container and the front end of the second container face each other;

wherein the first and second side panels of the first container are spaced to define a first interior width therebetween;

wherein the first and second front corner posts of the first container are spaced to define a second interior width therebetween;

wherein the first and second interior widths of the first container are substantially equal to each other; and wherein at least one front corner post of the first and second front corner posts of the first container comprises a base, a first leg and a second leg to form a U-shaped portion and further comprises an end connecting portion extending from the first leg and parallel to the base.

9. The storage container of claim 8, wherein a surface of the end connecting portion contacts an end portion of the corresponding side panel.

10. The storage container of claim 9, wherein the at least one front corner post includes both the first and second front corner posts, and wherein the second interior width is at least as great as a difference between the first interior width and a sum of respective thicknesses of the end connecting portions of the first and second front corner posts.

11. The storage container of claim 8, wherein the at least one front corner post further comprises a return end portion extending from the second leg and parallel to the base.

12. The storage container of claim 11, wherein the return end portion has a first end and a second end, and wherein the first end is attached to the second leg and the return end portion is longer than any remaining portion of the at least one front corner post that extends from the second end.

13. A storage container comprising:

a top front rail, a bottom front rail, a first front corner post, a second front corner post, a first side panel, and a second side panel, the top front rail, the bottom front rail, the first front corner post, and the second front corner post being disposed at a front end of the storage container to define an opening into an interior of the storage container, wherein the first and second side panels are spaced apart to define a first interior width therebetween, wherein the first and second front corner posts are spaced apart to define a second interior width therebetween, wherein each of the first and second front corner posts comprises:

a base;

a first leg including a first end attached to a first end of the base;

a second leg attached to a second end of the base opposite the first end of the base to form a U-shaped portion; and an end connecting portion extending from a second end of the first leg opposite the first end of the first leg, the end connecting portion contacting an end portion of a corresponding one of the first and second side panels, and wherein the second interior width is at least as great as a difference between the first interior width and a sum of respective thicknesses of the end connecting portions of the first and second front corner posts.

14. The storage container of claim 13, further comprising a front panel coupled between the first and second front corner posts.

15. A storage container comprising:

a top front rail, a bottom front rail, a first front corner post, a second front corner post, a first side panel, and a second side panel, the top front rail, the bottom front rail, the first front corner post, and the second front corner post being disposed at a front end of the storage container to define an opening into an interior of the storage container, wherein innermost surfaces of the first and second side panels in a widthwise direction extending between the first and second side panels are spaced apart to define a first interior width therebetween, wherein innermost surfaces of the first and second front corner posts in the widthwise direction are spaced apart to define a second interior width therebetween, wherein the first and second interior widths are substantially equal to each other, and wherein at least one front corner post of the first and second front corner posts comprises a base extending in a first direction from a first end to a second end, a first leg extending in a second direction from the second end of the base to a distal end, a second leg extending in the second direction from the first end of the base to a distal end to form a U-shaped portion together with the base and the first leg, and an end connecting portion extending in the first direction from the distal end of the first leg and parallel to the base, the end connecting portion contacting an end portion of a corresponding one of the first and second side panels.

16. The storage container of claim 15, wherein the at least one front corner post further comprises a return end portion extending in the first direction from the distal end of the second leg and parallel to the base.

* * * * *

UNITED STATES PATENT AND TRADEMARK OFFICE

CERTIFICATE OF CORRECTION

PATENT NO. : 8,100,279 B2
APPLICATION NO. : 11/699230
DATED : January 24, 2012
INVENTOR(S) : Ole Henrik Nielsen et al.

It is certified that error appears in the above-identified patent and that said Letters Patent is hereby corrected as shown below:

In the Claims

Column 11, Claim 8, line 65. After "coupled"

Insert -- between --

Signed and Sealed this
Nineteenth Day of June, 2012

David J. Kappos

David J. Kappos
*Director of the United States Patent and Trademark Office*